US011757230B2

(12) United States Patent
Mueller et al.

(10) Patent No.: US 11,757,230 B2
(45) Date of Patent: Sep. 12, 2023

(54) ELECTRICAL CONNECTOR ASSEMBLY WITH MATING LEVER AND CPA

(71) Applicant: APTIV TECHNOLOGIES LIMITED, St. Michael (BB)

(72) Inventors: Klaus Mueller, Ipsheim (DE); Rainer Schmidt, Nuremberg (DE); Bruno Barth, Fürth (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 238 days.

(21) Appl. No.: 17/482,538

(22) Filed: Sep. 23, 2021

(65) Prior Publication Data

US 2022/0102914 A1 Mar. 31, 2022

(30) Foreign Application Priority Data

Sep. 25, 2020 (EP) ..... 20198433

(51) Int. Cl.
*H01R 13/629* (2006.01)
*H01R 13/502* (2006.01)
(Continued)

(52) U.S. Cl.
CPC ..... *H01R 13/62955* (2013.01); *H01R 13/502* (2013.01); *H01R 13/631* (2013.01); *H01R 13/639* (2013.01)

(58) Field of Classification Search
CPC ..... H01R 13/62955; H01R 13/502; H01R 13/631; H01R 13/639; H01R 2201/26;
(Continued)

(56) References Cited

U.S. PATENT DOCUMENTS 7,438,570 B2 * 10/2008 Mori ..... H01R 13/62933 439/157
2018/0316128 A1 * 11/2018 Gunreben ..... H01R 13/6272
(Continued)

FOREIGN PATENT DOCUMENTS

EP 0731536 A2 9/1996
EP 2840664 B1 6/2016
(Continued)

OTHER PUBLICATIONS

European Search Report for European Application No. 20198433.3 dated Mar. 16, 2021.

*Primary Examiner* — Peter G Leigh
*Assistant Examiner* — Nader J Alhawamdeh
(74) *Attorney, Agent, or Firm* — Carlson, Gaskey & Olds, P.C.

(57) ABSTRACT

An electrical connector assembly has a housing, that houses at least one electrical contact and a mating lever that is arranged pivotable relative to the housing between an alignment position and a mating position. The mating lever is engageable with the electrical counter connector assembly, in order to move the electrical counter connector assembly along a mating direction A relative to the housing into a mated configuration, when being pivoted from the alignment position to the mating position. A connector position assurance member is arranged moveable relative to the housing so as to be moveable into a locked position, and an elastic element. The elastic element is associated with the connector position assurance member and urges the connector position assurance member into the locked position when the mating lever is in the mating position, so that the connector position assurance member locks the mating lever in the mating position.

19 Claims, 9 Drawing Sheets

(51) Int. Cl.
*H01R 13/631* (2006.01)
*H01R 13/639* (2006.01)

(58) Field of Classification Search
CPC ..... H01R 13/6295; H01R 13/62938; H01R 2107/00; H01R 13/40; H01R 13/629
See application file for complete search history.

(56) References Cited

U.S. PATENT DOCUMENTS

| | | | | |
|---|---|---|---|---|
| 2022/0102914 | A1* | 3/2022 | Mueller | H01R 13/62955 |
| 2022/0399680 | A1* | 12/2022 | Mizutani | H01R 13/62927 |
| 2023/0107655 | A1* | 4/2023 | Mizutani | H01R 13/639<br>439/157 |

FOREIGN PATENT DOCUMENTS

| | | | | |
|---|---|---|---|---|
| FR | 3008833 | B1 | | 1/2015 |
| JP | H06203912 | A | | 7/1994 |
| KR | 20140064289 | A | * | 5/2014 |
| KR | 20140064289 | A | | 5/2014 |

* cited by examiner

Section A-A

Section B-B

Section B-B

Section A-A

Section C-C

Section B-B

Section B-B

ELECTRICAL CONNECTOR ASSEMBLY WITH MATING LEVER AND CPA

CROSS-REFERENCE TO RELATED APPLICATIONS

This application claims priority to European Patent Application No. EP20198433.3 filed on Sep. 25, 2020.

FIELD OF THE INVENTION

The present disclosure relates to an electrical connector assembly, having a mating lever and a connector position assurance member (CPA), to a connector system, comprising said electrical connector assembly and to a method for mating the connector system.

BACKGROUND ART

Electrical connectors having a mating lever are known in the art. Those connectors are for example used in automotive vehicles for interconnecting power- and/or data lines.

From WO 2010/035 247 A2 a connector is known, that has a housing and a mating lever coupled thereto. When the mating lever is at an open position, the connector is ready to be mated with a corresponding counter connector. Further, when the mating lever is moved towards a closed position, the connectors are mated due to the pivoting movement of the mating lever.

However, known connectors and connector systems are prone to incorrect mating, particularly due to an incomplete closing of the lever. Incorrectly mated connector systems are problematic, as there may be an electric contact, despite to the incorrect mating. Thus, the incorrect mating cannot be detected by commonly used connection tests, such as a resistance testing. Due to the incorrect mating, the mated connector system, and therefore the electric contact, is prone to getting separated, e.g. due to vibrations, pulling forces applied on a cable, and/or the like.

In the field of automotive vehicles connectors are oftentimes obstructed by further parts and/or difficult to access after complete assembly of the vehicle. Thus, in case an incorrect mating occurs and said incorrect mating remains undetected during assembly, it may be difficult to establish a correct mating after assembly of the vehicle is completed and/or after delivery of the vehicle.

Furthermore, incorrectly mated connector systems may lead to severe security issues, e.g. if the connector system provides security relevant systems with signals and/or power. In this case, an unintentional separation of the connector system may lead to malfunction or failure of said security relevant systems. This is to be avoided.

Thus, it is an object of the present disclosure to provide an electrical connector assembly, a connector system and a mating method for said system that overcomes the aforementioned drawbacks at least partially.

SUMMARY OF THE INVENTION

These objects are achieved, at least partly, by an electrical connector assembly, a connector system and a method, as defined in the independent claims. Further aspects of the present disclosure are defined in the dependent claims.

In particular, the object is achieved by an electrical connector assembly according to claim 1. The electrical connector assembly comprises a housing, that houses at least one electrical contact. Said contact may be adapted for signal and/or power transmission. Particularly, the electrical connector assembly may comprise multiple electrical contacts, wherein some of the contacts may be adapted for power transmission and others for signal transmission.

The housing may be a female housing that is adapted to, at least partially, receive a housing of a corresponding (male) counter connector. Alternatively, the housing is a male housing that is adapted to, at least partially, be received in a housing of a corresponding (female) counter connector.

The electrical connector assembly comprises a mating lever that is arranged pivotable relative to the housing between an alignment position and a mating position. In the alignment position, the mating lever is opened. Thus, the mating lever allows an electrical counter connector assembly to be aligned with the housing of the connector assembly. Further, in the alignment position, the electrical counter connector assembly may be partially inserted into the housing, but not mated yet. Thus, in the alignment position, there is typically no electrical connection between the electrical connector assembly and the counter connector assembly.

In the mating position the mating lever is closed, and thus couples the housing of the connector assembly with the electrical counter connector assembly in a mated configuration. In the mated configuration, there is an electrical connection between the electrical connector assembly and the counter connector assembly.

The mating lever is configured to be engageable with the electrical counter connector assembly, in order to move the electrical counter connector assembly along a mating direction "A" relative to the housing of the connector assembly into the mated configuration, when being pivoted from the alignment position to the mating position. Thus, when the mating lever is closed, the electrical connector assembly and the counter connector assembly are guided into the mated configuration and an electrical connection is established.

The electrical connector assembly further comprises a connector position assurance member (CPA) that is arranged moveable relative to the housing so as to be moveable into a locked position. Particularly, the connector position assurance member may be supported by the housing so as to be axially slidable.

The electrical connector assembly further comprises an elastic element. Said elastic element may be integrally formed with the connector position assurance member or may be a separate element, such as a compression spring, particularly a spiral spring.

The elastic element is associated with the connector position assurance member and configured to urge the connector position assurance member into the locked position when the mating lever is in the mating position. In the locked position, the connector position assurance member locks the mating lever in the mating position. As the connector position assurance member locks the mating lever in the mating position, unintentionally opening the mating lever can be prevented. Thus, the mated configuration of the electrical connector assembly and the counter connector assembly is secured by the connector position assurance member.

The mating lever may include at least one first slide track that is engageable with a corresponding first slide member of the electrical counter connector assembly. The slide track may be formed as a groove, as an elongated through opening and/or the like. When being engaged with a corresponding first slide member, the first slide track guides the first slide member along the first slide track, when the mating lever is pivoted (i.e. opened and/or closed).

Particularly, the first slide track is shaped so that the pivoting movement of the mating lever is transferred into an axial movement of the electrical counter connector assembly via the first slide member, if the first slide member is engaged with the first slide track. The first slide track may have a curved shape and said curved shape optionally comprises a varying curvature radius, that may be chosen so that the pivoting moment for pivoting the mating lever from the alignment position to the mating position (i.e. closing the mating lever), or vice versa (i.e. opening the mating lever), is substantially independent of the mating resistance between the connector assembly and the electrical counter connector assembly. Particularly, with choosing the centers and/or curvature radii, the transmission ratio between the pivoting movement of the mating lever and the axial movement of the counter connector assembly relative to the housing of the connector assembly can be adapted. Thus, it is possible to provide an essentially constant actuating moment (pivoting moment) that has to be applied when the mating lever is closed and thereby mates the connector assembly with the counter connector assembly.

For example, a first segment of the first slide track may have a first curvature radius and a second segment may have second curvature radius that is different from the first curvature radius. The curvature radius of the first segment may be chosen so as to provide a pre-defined pivoting moment and the second curvature radius may be chosen so as to provide substantially the same pivoting moment as the first segment. As the curvature radii are different, a difference in mating resistance can be compensated. A difference in mating resistance may result from different parts that are mated. For example, upon mating the connector assembly with the counter connector assembly, in a first mating phase, the housings of the connector assembly/counter connector assembly are mated, resulting in a relatively low mating resistance. In a second phase, the electrical contacts of the connector assembly/counter connector assembly are mated, resulting in a higher mating resistance. This rise of mating resistance can be compensated by choosing different centers and/or curvature radii, resulting in different transmission ratios.

Further, the mating lever may include at least one second slide track that is engaged with a corresponding second slide member of the electrical connector assembly, particularly of the housing of the electrical connector assembly. In this configuration, the mating lever is arranged pivotable around a pivot pin that is supported slidably in a third slide track of the electrical connector assembly. The third slide track may be substantially parallel to the mating direction.

The second slide track may be shaped so that the pivoting movement of the mating lever is transferred into an axial movement of the mating lever relative to the housing via the second slide member. Said axial movement of the mating lever is transferred into an axial movement of the counter connector assembly, when the mating lever is engaged with the counter connector assembly.

The second slide track may be formed as a groove, as an elongated through opening and/or the like. When being engaged with a corresponding second slide member, the second slide track guides the second slide member along the second slide track, when the mating lever is pivoted (i.e. opened and/or closed).

The second slide track may have a curved shape and may optionally comprise a varying curvature radius, that is chosen so that the pivoting moment for pivoting the mating lever from the alignment position to the mating position (i.e. closing the mating lever), or vice versa (i.e. opening the mating lever) is substantially independent of the mating resistance between the connector assembly and the electrical counter connector assembly.

As for the first slide track, with choosing the center and the curvature radii, the transmission ratio between the pivoting movement of the mating lever and the axial movement of the mating lever relative to the housing of the connector assembly can be adapted. Thus, it is possible to provide an essentially constant actuating moment (pivoting moment) that has to be applied when closing the mating lever.

Further, in alternative embodiments the first slide track and/or the second slide track may be part of the housing of the connector assembly, or the counter connector assembly, respectively. In this alternative embodiment, the mating lever may include first and/or second slide members, that are engageable with the respective slide tracks.

The connector position assurance member (CPA) may comprise a locking means (at least one) and the mating lever may comprise a corresponding locking means (at least one). The locking means and the corresponding locking means are adapted to engage with each other, when the mating lever is in the mating position and the connector position assurance member is in the locked position, so as to hinder the mating lever from being pivoted out of the mating position. The engagement may be established due to an axial movement of the connector position assurance member, particularly in the mating direction "A".

When the locking means and the corresponding locking means engage with each other, the connector position assurance member locks the mating lever in the mating position. Accordingly, it unintentionally opening the mating lever can be prevented. Thus, the mated configuration of the electrical connector assembly and the counter connector assembly is secured by the connector position assurance member. Opening the mating lever may possible after retracting the connector position assurance member.

The locking means may be formed as a locking protrusion, that protrudes in mating direction "A". The corresponding locking means may be formed as a locking hook that is optionally provided on flexible locking arm, wherein the locking hook may engage with the locking protrusion, so as to hinder the mating lever from being opened.

The connector position assurance member may further comprise at least one pre-locking means, that is adapted to engage with a corresponding pre-locking means of the housing of the electrical connector assembly. The pre-locking means and the corresponding pre-locking means are adapted to engage with each other, so as to secure the connector position assurance member in a pre-locked position. In the pre-locked position, the connector position assurance member is retracted and allows the mating lever to be closed (i.e. moved into the mating position), and to be opened (i.e. moved away from the mating position).

The pre-locking means may be formed as a locking nose that is provided on a flexible arm of the connector position assurance member, wherein the flexible arm may have a bent-shape, such as a 180-degree bent-shape. The corresponding pre-locking means may be formed as a recess or a thorough opening that includes a locking shoulder, wherein the locking shoulder is adapted to engage with the pre-locking means. Optionally, the pre-locking means may be arranged so as to sandwich the locking means.

Further, the mating lever may comprise at least one releasing means that is arranged so as to release the engagement between the pre-locking means and the corresponding pre-locking means, when the mating lever is pivoted from the alignment position to the mating position (i.e. when being closed). The releasing means may be formed as a protrusion that is arranged so as to enter a corresponding pre-locking means, formed as a thorough opening. Said protrusion may deflect a flexible arm associated with the pre-locking means so as to disengage the pre-locking means and the corresponding pre-locking means, thereby releasing the connector position assurance member from the pre-locked position.

Further, the elastic element may be configured to urge the connector position assurance member out of the pre-locked position into the locked position, when the engagement between the pre-locking means and the corresponding pre-locking means is released. Particularly, the elastic element may be tensioned, when the connector position assurance member is in the pre-locked position. Optionally, the elastic element is received in a receptacle that is at least partially formed by the housing. Particularly, the elastic element may be tensioned between the housing and the connector position assurance member.

The connector position assurance member may be coupled to the housing. Further, the connector position assurance member may comprise at least one retention means and the housing may comprise at least one corresponding retention means. Particularly, the retention means and the corresponding retention means may engage with each other, in case the connector position assurance member is moved into the locked position or beyond the locked position in mating direction "A". Thus, the retention means and the corresponding retention means are configured to prevent the connector position assurance member to be decoupled from the housing.

Further, the elastic element may urge the connector position assurance member in mating direction, so as to bring the retention means (e.g. a locking shoulder) and the corresponding retention means (e.g. a corresponding locking shoulder) into engagement, when the connector position assurance member is neither in the locked nor in the pre-locked position. Thus, undesired movement of the connector position assurance member (such as clattering) can be avoided during transport and/or prior to mating.

The connector position assurance member may be configured to be moved back from the locked position into the pre-locked position (i.e. retracted), to release the mating lever. Optionally the connector position assurance member is adapted to pivot the mating lever out of the mating position, when being moved back into the pre-locked position. Thus, the mating lever is lifted after the connector position assurance member is retracted, and opening the mating lever is facilitated. The lifting of the connector position assurance member may be achieved due to a contact between the pre-locking means and the releasing means.

The connector position assurance member may give a tactile and/or acoustic feedback when being urged into the locked position. Thus, upon mating the electrical connector assembly with the electrical counter connector assembly, the closing of the mating lever is noticeable and thereby, the risk of an incorrect or incomplete mating is reduced.

The mating lever may be adapted to urge the connector position assurance member back, so as to tension the elastic element, when the mating lever is moved from the alignment position towards the mating position (i.e. closed) and subsequently to release the connector position assurance member so that the elastic element can urge the connector position assurance member into the locked position. According to this configuration, it is not necessary to bring the connector position assurance member in the pre-locked position prior to mating. Alternatively, the connector position assurance member can be retracked manually into the pre-locked position prior to mating.

Further, the mating lever may comprise a lever-locking element that is adapted to engage with a corresponding lever-locking element of the electrical counter connector assembly, so as to secure the lever in the mating position. This allows a redundant securing of the mating lever in the mating position. The lever-locking element may be formed as a locking hook that engages with a corresponding locking shoulder of the counter connector assembly. Further the lever-locking element may be integrally formed within the first slide track, e.g. in a wedge shape, that hinders the first slide member from sliding back, when the mating lever is closed, i.e. in the mating position.

Further, the object is at least partially achieved by an electrical connector system, comprising an electrical connector assembly as described above, and an electrical counter connector assembly. The electrical counter connector assembly of the system comprises a mating means, that may be a corresponding first slide member. In this system, the mating lever of the electrical connector assembly is configured to engage with the mating means of the electrical counter connector assembly, in order to move the electrical counter connector assembly along a mating direction A relative to the housing of the connector assembly into a mated configuration, when being pivoted from the alignment position to the mating position.

Further, the object is at least partially achieved by a method for mating the electrical connector system, wherein the method comprises the following steps:

providing an electrical connector assembly as described above, providing an electrical counter connector assembly;

aligning the electrical counter connector assembly with the electrical connector assembly, and engaging the mating lever of the electrical connector assembly with the electrical counter connector assembly;

pivoting the mating lever from the alignment position to the mating position (i.e. closing the mating lever), thereby moving the electrical counter connector assembly along a mating direction "A" relative to the housing of the connector assembly into the mated configuration, and urging, via the elastic element, the connector position assurance member into the locked position, when the mating lever is in the mating position, thereby locking, via the connector position assurance member the mating lever in the mating position.

The method may further comprise the steps of moving the connector position assurance member back from the locked position into a pre-locked position (retracting the connector position assurance member), to release the mating lever, optionally pivoting the mating lever out of the mating position via the connector position assurance member, upon moving the connector position assurance member back into the pre-locked position, and pivoting the mating lever into the alignment position (i.e. opening the mating lever) to allow separating the electrical connector assembly and the electrical counter connector assembly.

BRIEF DESCRIPTION OF THE DRAWINGS

In the following, the accompanying figures are briefly described.

DETAILED DESCRIPTION OF THE FIGURES

Figure 1:
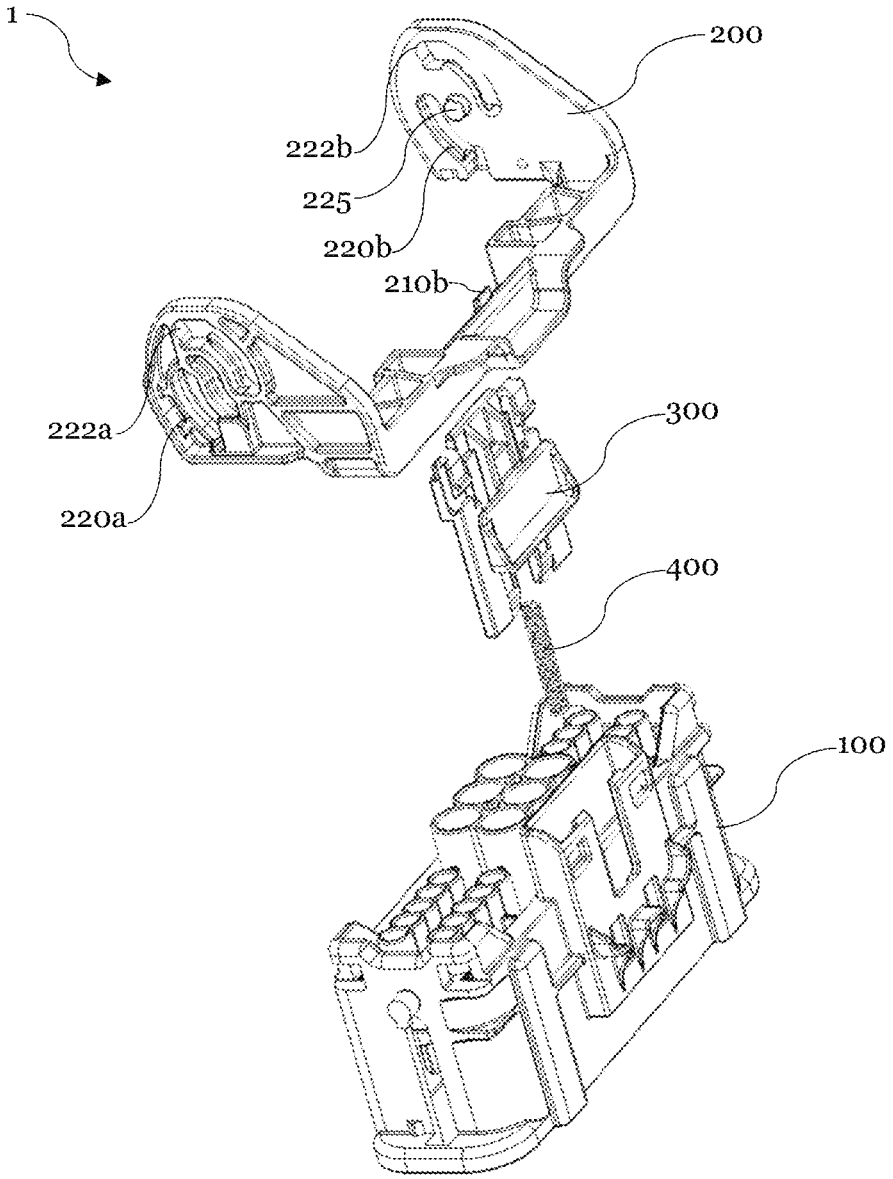
FIG. 1 is a schematic exploded view of a connector assembly, according to an embodiment of the present disclosure.

FIG. 1 is a schematic exploded view of a connector assembly 1, according to an embodiment of the present disclosure. The electrical connector assembly 1 comprises a housing 100, that houses at least one electrical contact (not shown). The housing 100 is a female housing that is adapted to, at least partially, receive a housing of a corresponding (male) counter connector 2 (cf. FIGS. 3A to 3C).

Figure 2A:
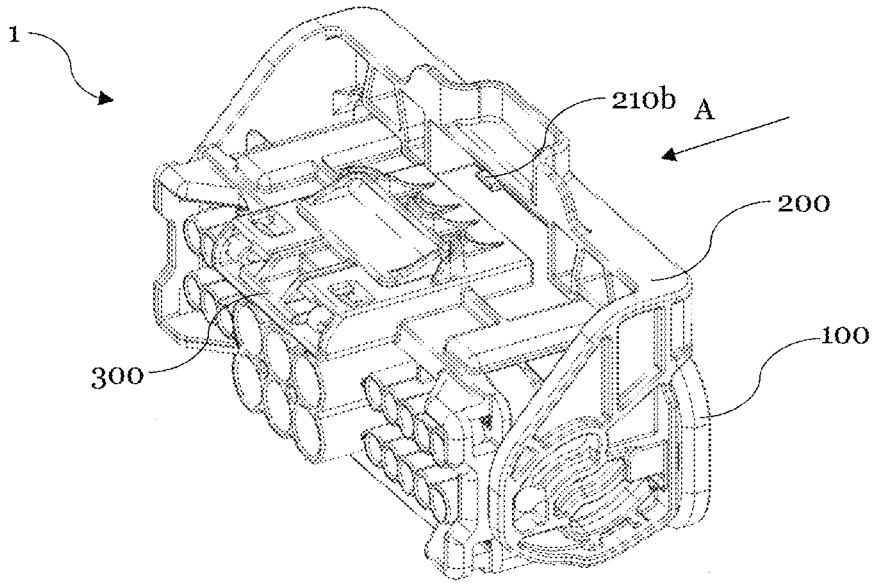
FIG. 2A is a schematic perspective view of a connector assembly, the lever being in an alignment position, according to an embodiment of the present disclosure.
Figure 2B:
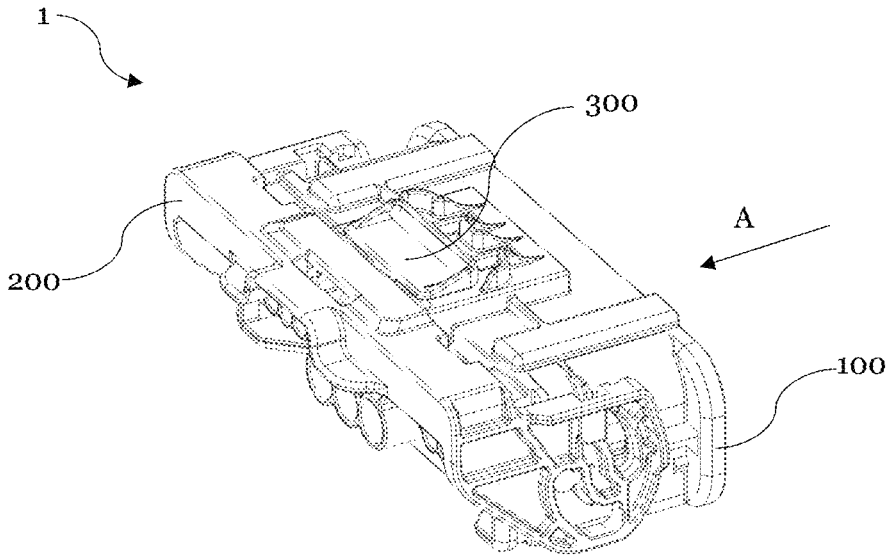
FIG. 2B is a schematic perspective view of a connector assembly, the lever being in a mating position, according to an embodiment of the present disclosure.

The electrical connector assembly 1 comprises a mating lever 200 that is arranged pivotable relative to the housing between an alignment position (as shown in FIG. 2A) and a mating position (as shown in FIG. 2B).

Figure 6A:
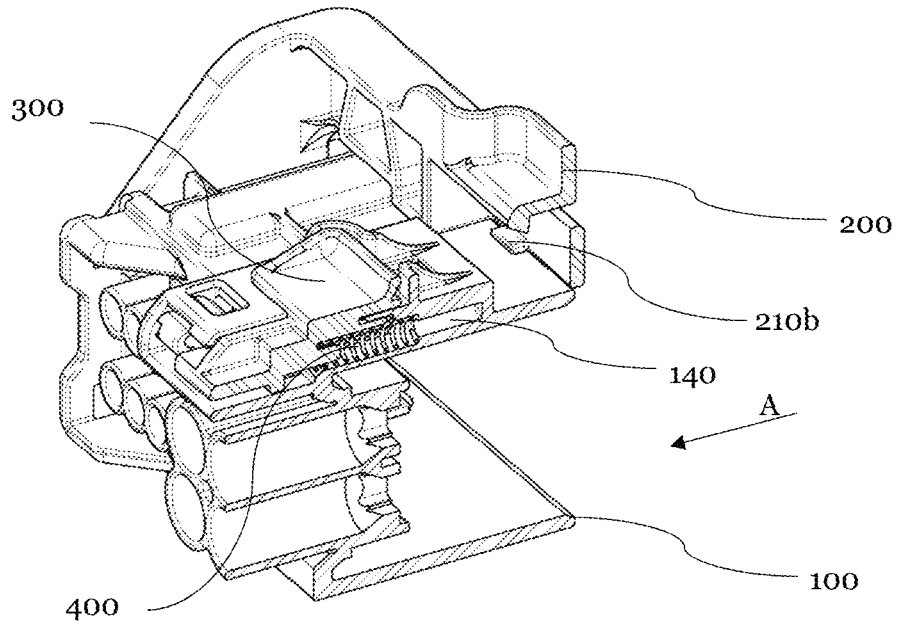
FIG. 6A gives schematic cut views of the connector assembly, the lever being in an alignment position.
Figure 6A:
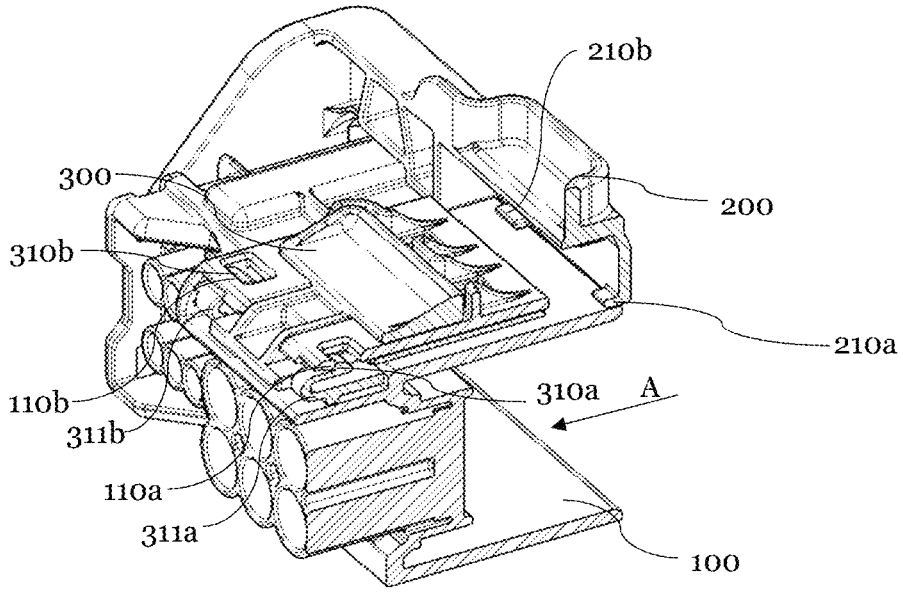
Figure 6B:
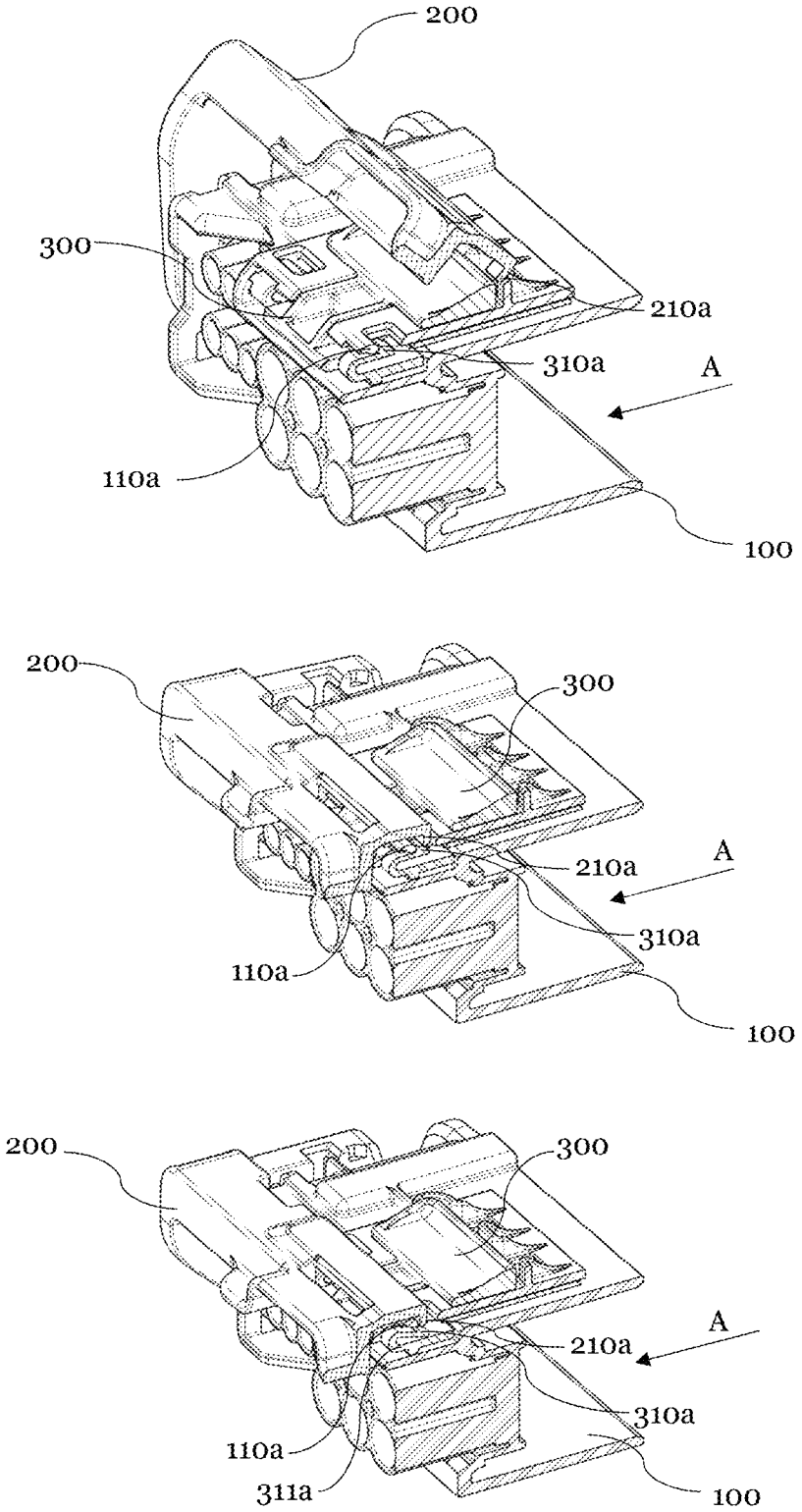
FIG. 6B gives schematic cut views of the connector assembly, when the lever is moved from the alignment position to a mating position.
Figure 6C:
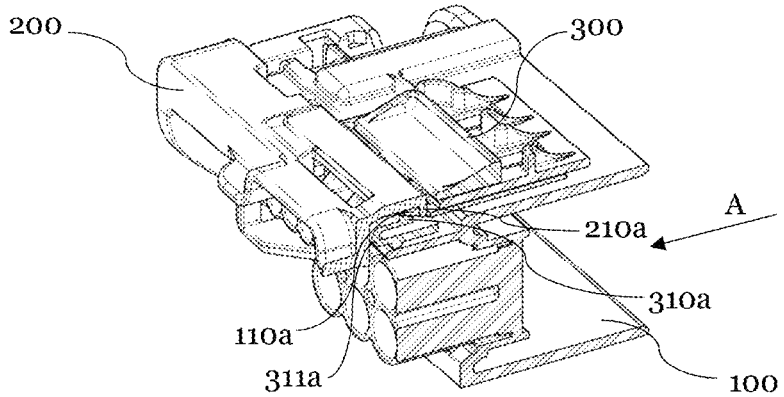
FIG. 6C gives schematic cut views of the connector assembly, when the lever is in the mating position, and FIG. 7 gives schematic cut views of the connector assembly, when the lever is moved out of the mating position.
Figure 6C:
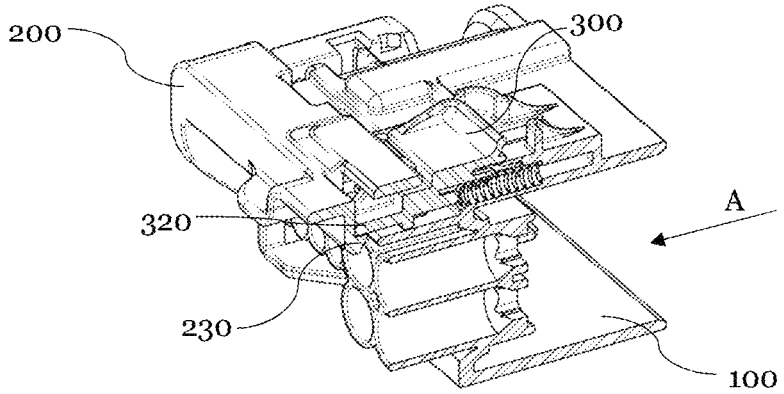
Figure 6C:
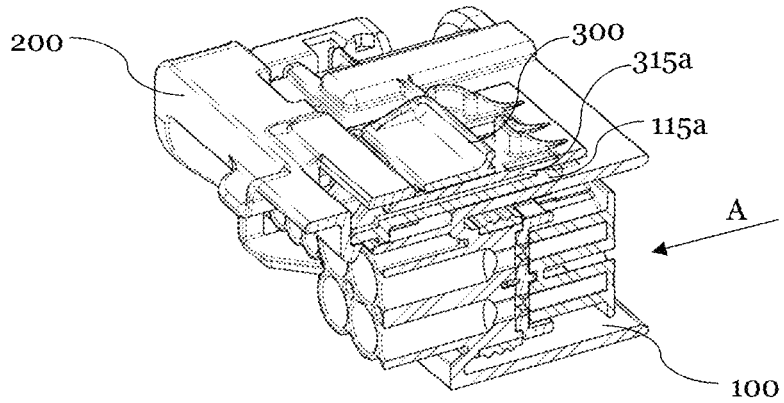

The electrical connector assembly 1 further comprises a connector position assurance member, CPA, 300 that is arranged moveable relative to the housing 100 so as to be moveable into a locked position (as shown in FIG. 6C, Section A-A). Particularly, the connector position assurance member 300 is supported by the housing 100 so as to be axially slidable.

The electrical connector assembly 1 further comprises an elastic element 400, which is a spiral spring in the embodiment of FIG. 1. The elastic element 400 is associated with the connector position assurance member 300 and configured to urge the connector position assurance member 300 into the locked position when the mating lever 200 is in the mating position. In the locked position, the connector position assurance member 300 locks the mating lever 200 in the mating position.

The alignment position of the mating lever 200 is shown in FIG. 2A. Here, the mating lever 200 is fully opened (alignment position). In the alignment position, the electrical counter connector assembly (not shown) can be aligned with the housing 100 of the connector assembly 1. Further, in the alignment position, the electrical counter connector assembly may be partially inserted into the housing, but not mated yet (as shown in FIG. 3A).

The mating position of the mating lever 200 is shown in FIG. 2B. Here, the mating lever 200 is fully closed (mating position). In the mating position the mating lever 200 couples the housing 100 of the connector assembly with the electrical counter connector assembly (not shown) in a mated configuration, as shown in FIG. 3C. In the mated configuration, there is an electrical connection between the electrical connector assembly and the counter connector assembly.

Figure 3A:
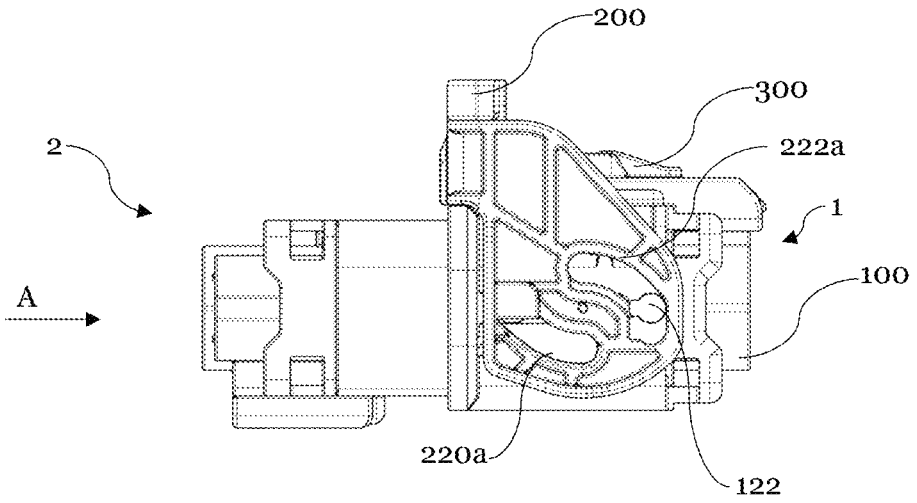
FIG. 3A is a schematic view of a connector system in an alignment position, according to an embodiment of the present disclosure.
Figure 3B:
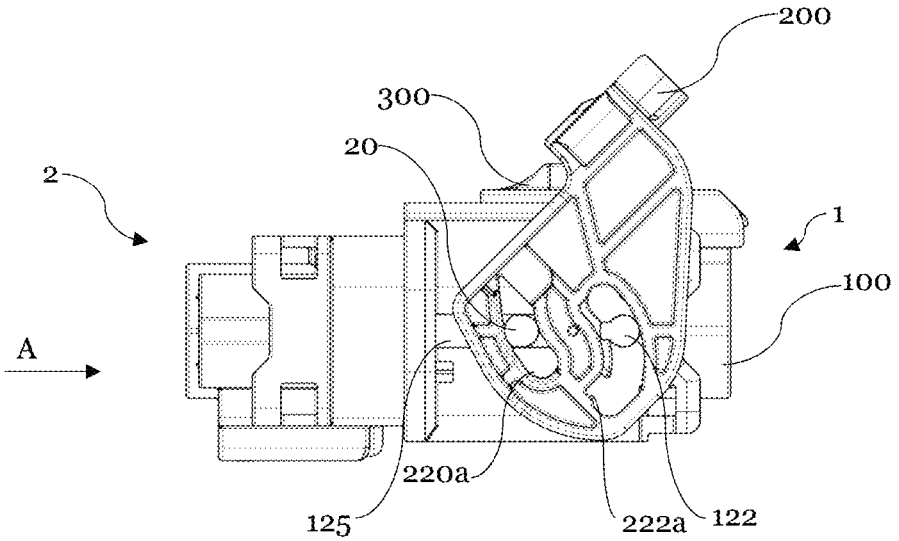
FIG. 3B is a schematic view of the connector system in an intermediate position.
Figure 3C:
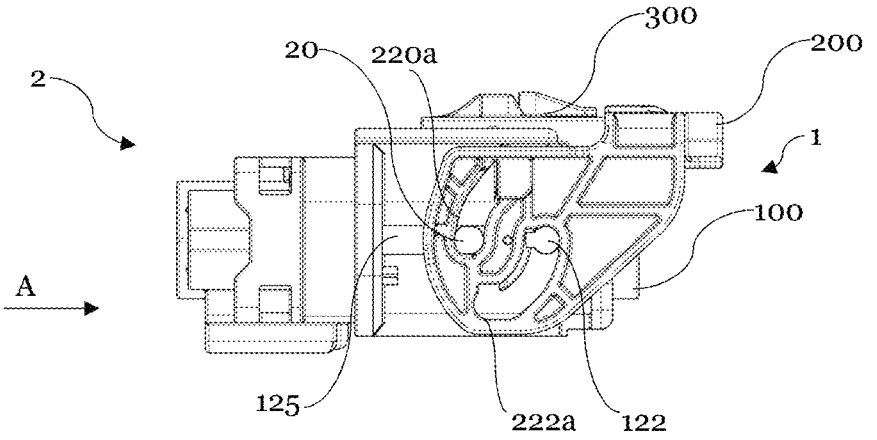
FIG. 3C is a schematic view of the connector system in a mating position.

FIGS. 3A to 3C show a pivoting sequence of the mating lever 200 and a respective mating sequence of the connector system, including the connector assembly 1 and the counter connector assembly 2, according to an embodiment of the present disclosure. The mating lever 200 is configured to be engageable with the electrical counter connector assembly 2, in order to move the electrical counter connector assembly 2 along a mating direction "A" relative to the housing 100 of the connector assembly 1 into the mated configuration, when being pivoted from the alignment position to the mating position. Thus, when the mating lever 200 is closed, the electrical connector assembly 1 and the counter connector assembly 2 are guided into the mated configuration and an electrical connection is established. In FIG. 3A, the mating lever 200 is in the alignment position, i.e. opened. In FIG. 3B, the system is shown, wherein the mating lever 200 is in an intermediate position. In FIG. 3C, the system is shown, wherein the mating lever 200 is in the mating position, i.e. closed.

In the embodiment of FIGS. 3A to 3C the mating lever 200 includes a first slide track 220*a* that is engaged with a corresponding first slide member 20 of the electrical counter connector assembly 2. The first slide member 20 is formed as a pin, laterally protruding from the electrical counter connector assembly 2 and being received within the first slide track 220*a*. The first slide track 220*a* is formed as an elongated through opening and guides the first slide member 20 when the mating lever 200 is pivoted (i.e. opened and/or closed).

Particularly, the first slide track 220*a* is shaped so that the pivoting movement of the mating lever 200 is transferred into an axial movement of the electrical counter connector assembly 2 via the first slide member 20. The first slide track 220*a* has a curved shape that defines a transmission ratio between the pivoting movement of the mating lever 200 and the axial movement of the counter connector assembly 2 relative to the housing 100 of the connector assembly 1. By choosing the curvature radius (respectively curvature radii of different curvature segments), it is possible to provide an essentially constant actuating moment (pivoting moment) that has to be applied when closing the mating lever 200. As for example shown in FIG. 1, the mating lever 200 may comprises multiple first slide tracks 220*a*, 220*b* that are arranged laterally on opposing sides of the mating lever (cf. FIG. 1).

Further, the mating lever 200 includes at least one second slide track 222*a* that is engaged with a corresponding second slide member 122 of the electrical connector assembly 1, particularly of the housing 100 of the electrical connector assembly 1. In this configuration, the mating lever 200 is arranged pivotable around a pivot pin 225 (cf. FIG. 1) that is supported slidably in a third slide track 125 of the electrical connector assembly 1. The second slide track 222*a* is shaped so that the pivoting movement of the mating lever 200 is transferred into an axial movement of the mating lever 200 relative to the housing 100 via the second slide member 122. Said axial movement of the mating lever 200 is transferred into an axial movement of the counter connector assembly 2, as the mating lever 200 is engaged with the counter connector assembly 2.

The second slide track 222*a* is formed as an elongated through opening and guides the second slide member 122 when the mating lever 200 is pivoted (i.e. opened and/or closed). The second slide track 222*a* has a curved shape that defines a transmission ratio between the pivoting movement of the mating lever 200 and the axial movement of the mating lever 200 relative to the housing 100 of the connector assembly 1. By choosing the curvature radius (respectively curvature radii of different curvature segments), it is possible to provide an essentially constant actuating moment (pivoting moment) that has to be applied when closing the mating lever 200. As for example shown in FIG. 1, the mating lever 200 may comprises multiple second slide tracks 222*a*, 222*b* that are arranged laterally on opposing sides of the mating lever (cf. FIG. 1).

Thus, when pivoting the mating lever 200 from the alignment position (cf. FIG. 3A) to the mating position (cf. FIG. 3C), the aligned counter connector assembly 2 is guided into the connector assembly 1 and mated to establish an electrical connection. In the mating position, the connector position assurance member 300 is urged into the locked position and locks the mating lever 200 in the mating position.

Figure 4A:
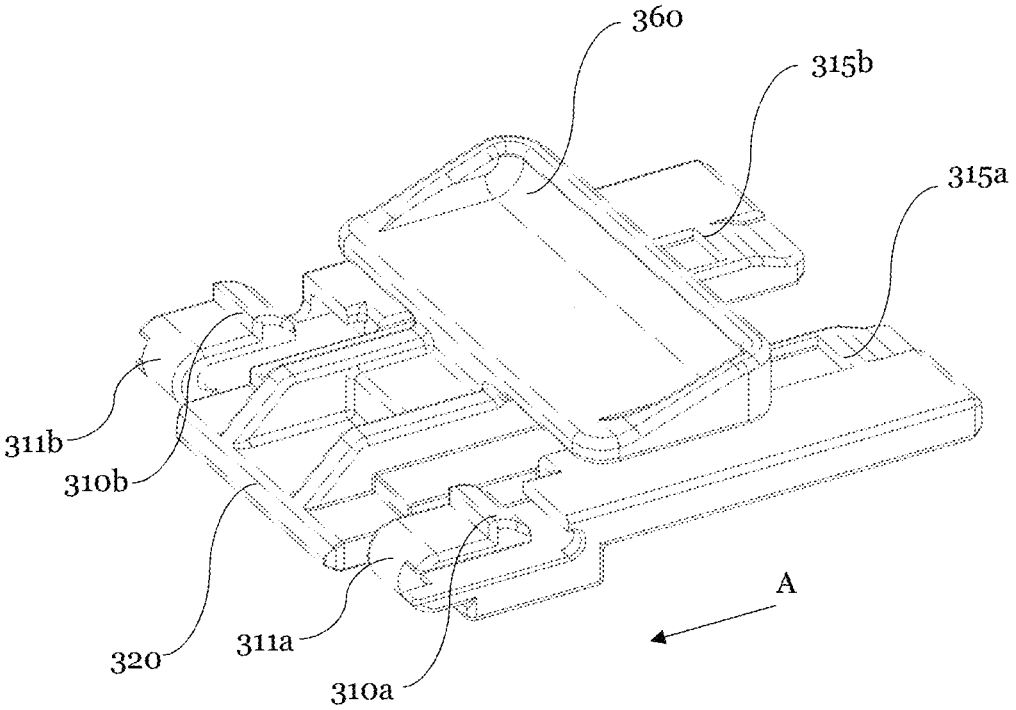
FIG. 4A is a schematic perspective view of a CPA-member, according to an embodiment of the present disclosure.
Figure 4B:
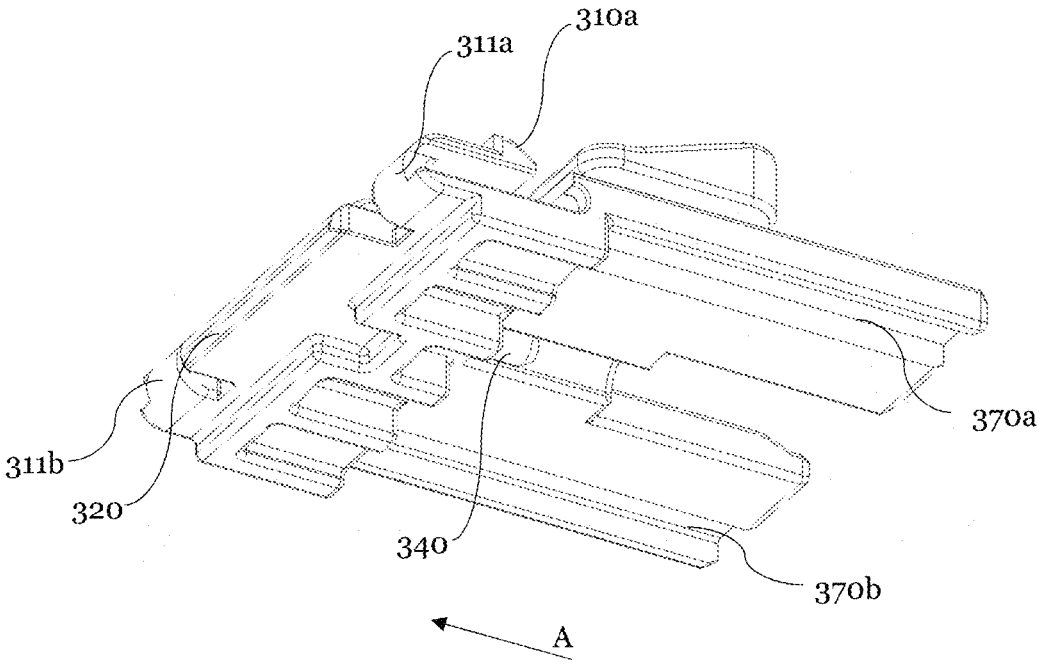
FIG. 4B is a further schematic perspective view of the CPA-member.

FIG. 4A gives a schematic top view of a connector position assurance member, CPA, 300 and FIG. 4B gives is a schematic bottom view of the connector position assurance member 300, according to an embodiment of the present disclosure. The functionality of the connector position assurance member 300 and its means is explained in more detail with reference to FIGS. 6 and 7. The connector position assurance member 300 comprises a locking means 320 that is arranged centrally and that protrudes in the mating direction A. The connector position assurance member 300, as shown in FIG. 4A, comprises two pre-locking means 310*a*, 310*b*, that are adapted to engage with corresponding pre-locking means of the housing, respectively.

The pre-locking means 310*a*, 310*b* are formed as a locking noses that are each provided on a flexible arm 311*a*, 311*b* of the connector position assurance member 300. In this embodiment, each flexible arm 311*a*, 311*b* has a 180-degree bent-shape. However, the flexible arm(s) may be shaped differently. The pre-locking means 310*a*, 310*b* are arranged so as to sandwich the locking means 320.

Further, the connector position assurance member 300 may comprise at least one retention means 315*a*, 315*b*, formed as locking shoulder. The retention means are configured to prevent the connector position assurance member to be decoupled from the housing.

For retracting the connector position assurance member 300, the connector position assurance member 300 may comprise an actuating means 360, formed as (finger) recess, a rib and/or the like. Guide grooves 370*a*, 370*b* may be provided within the connector position assurance member 300, for supporting the connector position assurance member 300 axially moveable. Further, for supporting the elastic element, the connector position assurance member 300 may comprise a flexible element support means 340, such as a pin, for supporting the elastic element (spring) axially.

Figure 5:
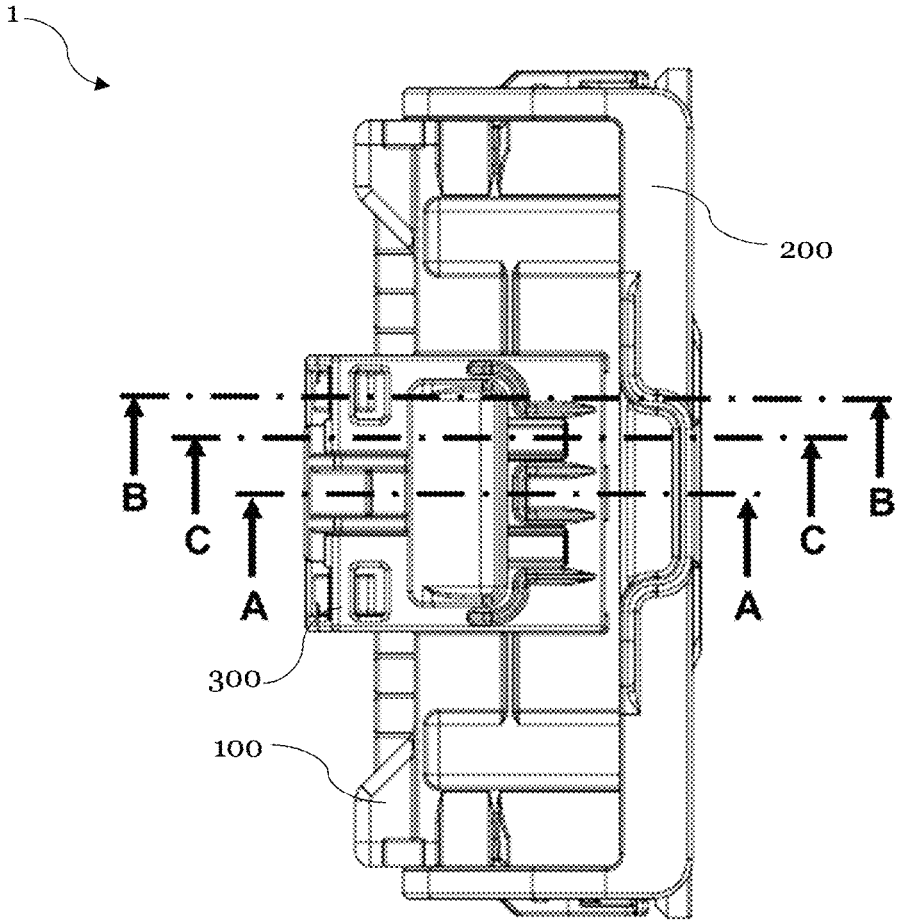
FIG. 5 is a schematic perspective view of a connector assembly, defining cutting planes of FIGS. 6A to 7, according to an embodiment of the present disclosure.
Figure 7:
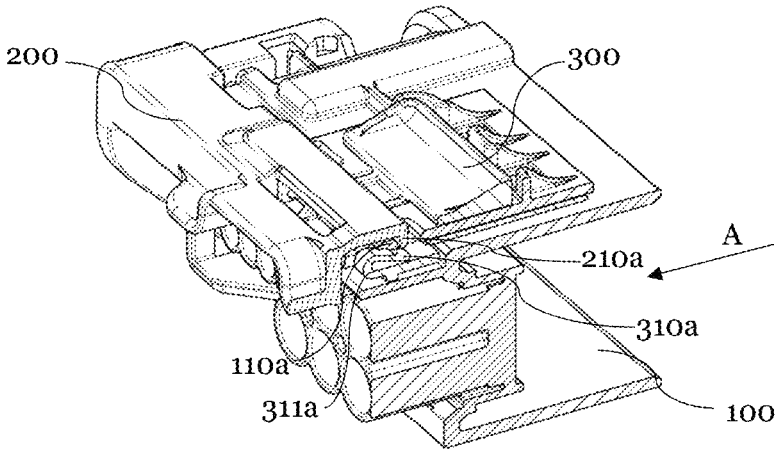
Figure 7:
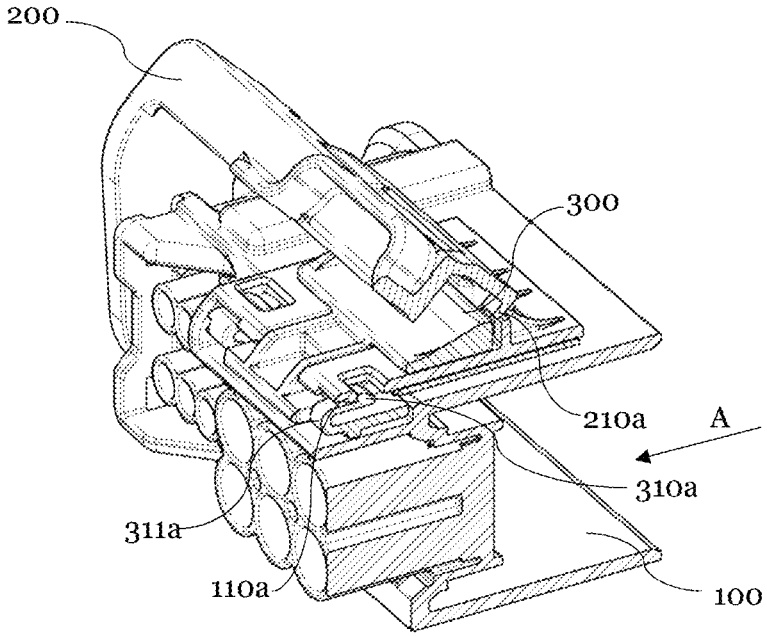

FIG. 5 is a schematic top view of a connector assembly 1, defining the cutting planes A-A B-B and C-C of FIGS. 6A to 7, according to an embodiment of the present disclosure.

FIG. 6A gives schematic cut views of the connector assembly 1, wherein the mating lever 200 is in the alignment position, i.e. opened and wherein the connector position assurance member 300 is in the pre-locked position.

As shown in section A-A, the elastic element 400 is received in a receptacle 140 that is at least partially formed by the housing 100. Further, the elastic element is tensioned between the housing 100 and the connector position assurance member 300 and configured to urge the connector position assurance member 300 out of the pre-locked position into the locked position, when the engagement between the pre-locking means 310*a*, 310*b* and the corresponding pre-locking means 110*a*, 110*b* is released.

As shown in section B-B the pre-locking means 310*a*, 310*b* and the corresponding pre-locking means 110*a*, 110*b* are engaged with each other, so as to secure the connector position assurance member 300 in a pre-locked position. In the pre-locked position, the connector position assurance member 300 is retracted and allows the mating lever 200 to be closed (i.e. moved into the mating position).

As described above with reference to FIGS. 4A and 4B, each of the pre-locking means 310*a*, 310*b* may be formed as a locking nose that is provided on respective a flexible arm 311*a*, 311*b* of the connector position assurance member 300. The corresponding pre-locking means 110*a*, 110*b* are each formed as a thorough opening, that includes a locking shoulder. The locking shoulder engages with one of the pre-locking means 310*a*, 310*b*, as shown in section B-B.

FIG. 6B gives schematic cut views (each in section B-B) of the connector assembly 1, in different positions of the mating lever 200. In top-most view, the mating lever 200 is in an intermediate position. In the middle view, the mating lever 200 begins to release the connector position assurance member 300 and in the lowermost view, the connector position assurance member 300 is released. In the top-most view, the connector position assurance member 300 is in the pre-locked position, and the pre-locking means 310*a* and the corresponding pre-locking means 110*a* are engaged. In the middle view, the mating lever 200 is closed further, and the releasing means 210*a*, 210*b* of the mating lever 200 come into contact with the pre-locking means 310*a*, 310*b*. When the mating lever 200 is pivoted further into direction of the mating position (lowermost view), the releasing means 210*a*, 210*b* deflect flexible arm(s) 110*a* associated with the pre-locking means 310*a*, 310*b* so as to disengage the pre-locking means 310*a*, 310*b* and the corresponding pre-locking means 110*a*, 110*b*, thereby releasing the connector position assurance member from the pre-locked position. Thus, the elastic element (not shown) can urge the connector position assurance member 300 out of the pre-locked position into the locked position as shown in FIG. 6C (section A-A).

FIG. 6C gives schematic cut views in sections B-B, A-A and C-C of the connector assembly 1, when the mating lever 200 is in the mating position. As shown in section B B, the engagement between the pre-locking means 310*a* and the corresponding pre-locking means 110*a* is released and the connector position assurance member 300 is moved in the locked position.

In section A-A of FIG. 6C, the locking means 320 of the connector position assurance member 300 is engaged with a corresponding locking means 230 of the mating lever 200 so as to hinder the mating lever 200 from being pivoted out of the mating position. Further, as shown in section C-C the retention means 315*a* of the connector position assurance member 300 is in engagement with a corresponding retention means 115*a* of the housing 100. This engagement prevents the connector position assurance member 300 from being decoupled from the housing 100.

FIG. 7 gives a schematic cut views of the connector assembly, when the mating lever is opened, i.e. moved out of the mating position. In the first view of FIG. 7, the connector position assurance member 300 is retracted and the pre-locking means is brought back in engagement with the corresponding pre-locking means. Thereby, the releasing means is urged upwards (in the orientation shown in FIG. 7) and the mating lever is slightly lifted. In the lower view of FIG. 7, the mating lever is pivoted back in direction of the alignment position and the connector position assurance member 300 is in the pre-locked position again.

When the mating lever is brought back into the alignment position the electrical connector assembly and the electrical counter connector can be entirely separated. For separating the electrical connector assembly and the electrical counter connector, the electrical counter connector is moved relative to the electrical connector assembly in a direction opposite to the mating direction A.

The invention claimed is:

1. An electrical connector assembly comprising:

a housing, that houses at least one electrical contact;

a mating lever that is arranged pivotable relative to the housing between an alignment position and a mating position, wherein in the alignment position, the mating lever allows an electrical counter connector assembly to be aligned with the housing of the connector assembly, and in the mating position the mating lever couples the housing of the connector assembly with the electrical counter connector assembly in a mated configuration, wherein the mating lever is configured to be engageable with the electrical counter connector assembly, in order to move the electrical counter connector assembly along a mating direction relative to the housing of the connector assembly into the mated configuration, when being pivoted from the alignment position to the mating position, wherein the electrical connector assembly further comprises a connector position assurance, CPA, member that is arranged moveable relative to the housing so as to be moveable into a locked position, an elastic element, wherein the elastic element is associated with the connector position assurance member and configured to urge the connector position assurance member into the locked position when the mating lever is in the mating position, so that the connector position assurance member locks the mating lever in the mating position, wherein the mating lever includes at least one first slide track that is engageable with a corresponding first slide member of the electrical counter connector assembly, wherein the first slide track is shaped so that the pivoting movement of the mating lever is transferred into an axial movement of the electrical counter connector assembly via the first slide member, if the first slide member is engaged with the first slide track, wherein the mating lever includes at least one second slide track that is engaged with a corresponding second slide member of the connector assembly, and wherein the second slide track is shaped so that the pivoting movement of the mating lever is transferred into an axial movement of the mating lever relative to the housing via the second slide member.

2. The electrical connector assembly according to claim 1, the first slide track has a curved shape and wherein the curved shape optionally comprises a varying curvature radius, that is chosen so that the pivoting moment for pivoting the mating lever from the alignment position to the mating position is substantially independent of the mating resistance between the connector assembly and the electrical counter connector assembly.

3. The electrical connector assembly according to claim 2, wherein the mating lever is arranged pivotable around a pivot pin that is supported slidably in a third slide track of the electrical connector assembly, wherein the second slide track has a curved shape and wherein the curved shape optionally comprises a varying curvature radius, that is chosen so that the pivoting moment for pivoting the mating lever from the alignment position to the mating position is substantially independent of the mating resistance between the connector assembly and the electrical counter connector assembly.

4. The electrical connector assembly according to claim 1, wherein the connector position assurance member comprises a locking means and wherein the mating lever comprises a corresponding locking means, the locking means and the corresponding locking means are adapted to engage with each other, when the mating lever is in the mating position and the connector position assurance member is in the locked position, so as to hinder the mating lever from being pivoted out of the mating position.

5. The electrical connector assembly according to claim 1, wherein the connector position assurance member comprises at least one pre-locking means, that is adapted to engage with a corresponding pre-locking means of the housing, wherein the pre-locking means and the corresponding pre-locking means are adapted to engage with each other, so as to secure the connector position assurance member in a pre-locked position.

6. The electrical connector assembly according to claim 5, wherein the mating lever comprises at least one releasing means that is arranged so as to release the engagement between the pre-locking means and the corresponding pre-locking means, when the mating lever is pivoted from the alignment position to the mating position, and wherein the elastic element is configured to urge the connector position assurance member out of the pre-locked position into the locked position, when the engagement between the pre-locking means and the corresponding pre-locking means is released.

7. The electrical connector assembly according to claim 1, wherein the elastic element is tensioned, when the connector position assurance member is in the pre-locked position.

8. The electrical connector assembly according to claim 7 wherein the elastic element is received in a receptacle that is at least partially formed by the housing.

9. The electrical connector assembly according to claim 1, wherein the connector position assurance member is coupled to the housing, wherein the connector position assurance member comprises at least one retention means and the housing comprises at least one corresponding retention means, and wherein the retention means and the one corresponding retention means are configured to prevent the connector position assurance member to be decoupled from the housing.

10. The electrical connector assembly according to claim 1, wherein the connector position assurance member can be moved back from the locked position into the pre-locked position, to release the mating lever.

11. The electrical connector assembly according to claim 10, wherein the connector position assurance member is adapted to pivot the mating lever out of the mating position, when being moved back into the pre-locked position.

12. The electrical connector assembly according to claim 1, wherein the connector position assurance member gives a tactile and/or acoustic feedback when being urged into the locked position.

13. The electrical connector assembly according to claim 1, wherein the mating lever is adapted to urge the connector position assurance member back, so as to tension the elastic element, when the mating lever is moved from the alignment position towards the mating position and subsequently to release the connector position assurance member so that the elastic element can urge the connector position assurance member into the locked position.

14. The electrical connector assembly according to claim 1, wherein the mating lever comprises a lever-locking element that is adapted to engage with a corresponding lever-locking element of the electrical counter connector assembly, so as to secure the lever in the mating position.

15. An electrical connector system, comprising an electrical connector assembly according to claim 1; and an electrical counter connector assembly, wherein the electrical counter connector assembly comprises a mating means, wherein the mating lever of the electrical connector assembly is configured to engage with the mating means of the electrical counter connector assembly, in order to move the electrical counter connector assembly along a mating direction relative to the housing of the connector assembly into a mated configuration, when being pivoted from the alignment position to the mating position.

16. The electrical connector assembly according to claim 15, wherein the mating means is a corresponding first slide member.

17. A method for mating an electrical connector system according to claim 13, wherein the method comprises the following steps:

providing the electrical connector assembly;

providing an electrical counter connector assembly;

aligning the electrical counter connector assembly with the electrical connector assembly, and engaging the mating lever of the electrical connector assembly with the electrical counter connector assembly;

pivoting the mating lever from the alignment position to the mating position, thereby moving the electrical counter connector assembly along a mating direction relative to the housing of the connector assembly into the mated configuration, urging, via the elastic element, the connector position assurance member into the locked position when the mating lever is in the mating position, thereby locking, via the connector position assurance member the mating lever in the mating position.

18. The method according to claim 17, further comprising;

moving the connector position assurance member back from the locked position into a pre-locked position, to release the mating lever.

19. The method according to claim 18, further comprising:

pivoting the mating lever out of the mating position via the connector position assurance member, upon moving the connector position assurance member back into the pre-locked position, and pivoting the mating lever into the alignment position to allow separating the electrical connector assembly and the electrical counter connector assembly.

* * * * *